US005769469A

United States Patent [19]

Zemke

[11] Patent Number: 5,769,469

[45] Date of Patent: Jun. 23, 1998

[54] WINDOW LATCH

[76] Inventor: William L. Zemke, 299 S. Shore Dr., Forest Lake, Minn. 55025

[21] Appl. No.: 490,387

[22] Filed: Jun. 14, 1995

[51] Int. Cl.[6] ..... E05C 3/04

[52] U.S. Cl. ..... 292/241; 292/204

[58] Field of Search ..... 292/241, 204, 292/DIG. 47, 242

[56] References Cited

U.S. PATENT DOCUMENTS

| | | | |
|---|---|---|---|
| 110,733 | 1/1871 | Breckenridge . | |
| 112,717 | 3/1871 | Judd . | |
| 126,754 | 5/1872 | Sparks . | |
| 159,365 | 2/1875 | Snow | 292/241 |
| 197,848 | 12/1877 | Griscom . | |
| 375,528 | 12/1887 | Beecher | 292/242 |
| 564,426 | 7/1896 | Hubbard . | |
| 1,122,026 | 12/1914 | O'Rourke . | |
| 1,742,764 | 1/1930 | Giltsch et al. | 292/204 X |
| 2,135,105 | 11/1938 | Knauff | 292/206 |
| 2,422,723 | 6/1947 | Fisher | 292/204 |
| 2,506,879 | 5/1950 | Lieb | 292/241 |
| 3,645,573 | 2/1972 | Strang | 292/241 |
| 3,811,718 | 5/1974 | Bates | 292/241 |
| 4,611,841 | 9/1986 | Ravinet | 292/241 |
| 4,801,164 | 1/1989 | Mosch | 292/204 |
| 5,219,193 | 6/1993 | Piltingsrud | 292/240 |
| 5,505,505 | 4/1996 | Follows | 292/DIG. 47 |
| 5,582,446 | 12/1996 | Olsen et al. | 292/241 |

FOREIGN PATENT DOCUMENTS

| | | | |
|---|---|---|---|
| 328332 | 1/1903 | France | 292/241 |
| 3010-012 | 10/1980 | Germany . | |
| 786 | of 1899 | United Kingdom | 292/241 |

*Primary Examiner*—Rodney M. Lindsey
*Attorney, Agent, or Firm*—Merchant, Gould, Smith, Edell, Welter & Schmidt, P.A.

[57] ABSTRACT

A window latch includes a catch that is movable into and out of engagement with a keeper. A handle is connected to the catch and rotates relative to a base to move the catch relative to the keeper. Rotation of the handle relative to the base also causes axially movement of another member between positions of relatively greater and relatively lesser stability. The positions of relatively greater stability correspond to complete engagement and complete disengagement of the catch and the keeper.

30 Claims, 3 Drawing Sheets

WINDOW LATCH

FIELD OF THE INVENTION

The present invention relates to a mechanism for latching objects against movement relative to one another, and in a preferred application, to a latch for a double hung window.

BACKGROUND OF THE INVENTION

Numerous latches suitable for use on double hung windows are known in the art. Many such latches typically include a catch portion, which is secured to a lower window sash, and a keeper portion, which is secured to an upper window sash. The catch portion is moved into engagement with the keeper portion to latch the sashes against movement relative to one another, and the catch portion is moved clear of the keeper portion and the upper window sash to allow movement of the sashes relative to one another. In some window assemblies, both sashes move relative to the frame, while in other window assemblies, one sash is fixed to the frame, and the other sash moves relative to the frame and the fixed sash.

Those skilled in the art will recognize room for improvement of known latches of this type. For example, some latches for double hung windows do not operate particularly smoothly and/or fail to provide user feedback to signal whether or not the window is fully latched or fully unlatched. Also, some such window latches do not address the possibility of the latch migrating from a desired position. For example, some latches on opened windows may drift toward a latched position and cause damage when a person attempts to close the window. Similarly, some latches on closed and latched windows may drift to an unlatched or partially latched position, thereby defeating the purpose of the latch.

Another problem with many known latches for double hung windows and the like takes the form of complications in the installation process. For example, many such latches have protruding parts that must be nested within the top rail of the lower sash, otherwise known as the check rail. As a result, work must be performed on the check rail prior to installation of the latch. Features such as manufacturability, user friendliness, and durability present significant design considerations, as well.

SUMMARY OF THE INVENTION

A preferred embodiment of the present invention is a latch suitable for use on double hung windows and the like. For example, those skilled in the art will recognize that the preferred embodiment is also suitable for use on glider windows.

The preferred embodiment latch includes a catch portion that may be secured to a first or lower window sash, and a keeper portion that may be secured to a second or upper window sash. The catch portion is selectively moved into and out of engagement with the keeper portion to latch and unlatch the sashes relative to one another.

The catch portion includes a bearing member, a rotor, and a spring arranged in series within a base. These components are enclosed between a handle and a cover extending across an opening in the base. Compression in the spring forces the rotor toward the bearing member, and interengaging surfaces on the rotor and the bearing member are contoured in such a manner that less energy is stored in the spring when the catch portion is entirely engaged or entirely disengaged relative to the keeper portion, and more energy is stored in the spring when the catch portion is between orientations of complete engagement or disengagement. In this manner, the spring urges the handle toward orientations corresponding to complete engagement or disengagement of the catch portion relative to the keeper portion. A stop on the base engages a groove on the handle to limit rotation of the handle to extremes that correspond to these orientations of complete engagement or disengagement.

The cover and the base cooperate to provide a flat surface that may be mounted flush on the check rail of a window sash. The only alterations to the check rail are two screw holes by which the latch is mounted (with screws) to the sash. Those skilled in the art will recognize other suitable mounting means, such as adhesives, which do not require any alterations to the check rail.

The spring biasing assembly is simple in construction, requires few parts, and occupies little space, yet facilitates smooth and reliable latch operation. The spring biasing also provides user feedback to improve the likelihood that the latch will be entirely engaged or disengaged. These are some of the many advantages of the present invention which will become apparent to those skilled in the art upon a more detailed description of the preferred embodiment.

BRIEF DESCRIPTION OF THE DRAWING

With reference to the Figures of the Drawing, wherein like numerals represent like parts and assemblies throughout the several views.

DETAILED DESCRIPTION OF THE PREFERRED EMBODIMENT

Figure 1:
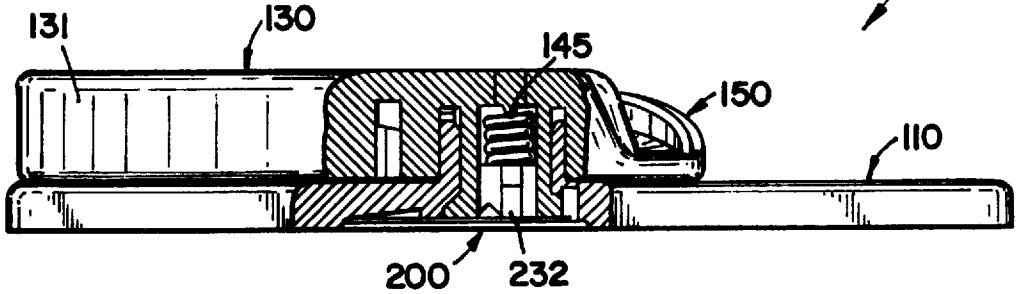
FIG. 1 is a partially sectioned, rear view of a catch portion of a preferred embodiment latch mechanism constructed according to the principles of the present invention.
Figure 7:
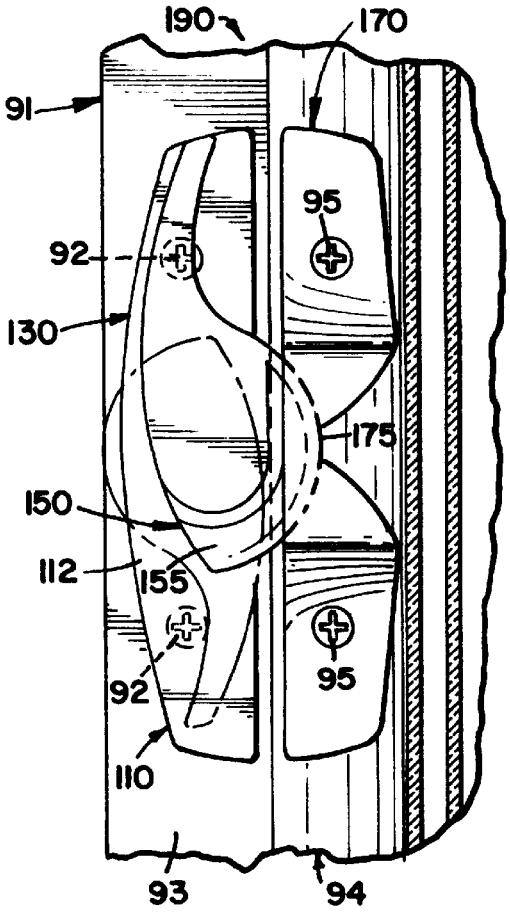
FIG. 7 is a top view of the catch portion shown in FIG. 1, as well as a corresponding keeper portion, depicted relative to respective check rails on adjacent double hung window sashes.

A preferred embodiment latch mechanism constructed according to the principles of the present invention is designated as 190 in FIG. 7. The latch mechanism 190 generally includes a catch portion 100 and a keeper portion 170. As shown in FIG. 1, the catch portion 100 includes a base 110, a handle 130, a catch 150, and a means 200 for snapping the handle 130 between a first position, wherein the catch 150 and the keeper 170 are interengaged, and a second position, wherein the catch 150 and the keeper 170 are disengaged.

Figure 2:
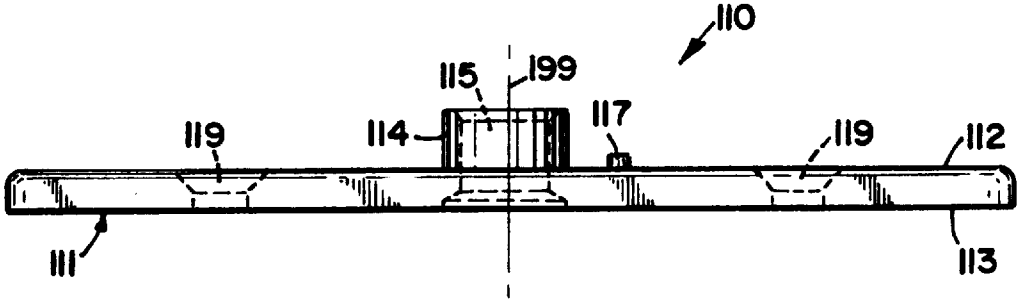
FIG. 2 is a rear view of a base that is a part of the catch portion shown in FIG. 1.

As shown in FIG. 2, the base 110 includes a generally flat plate 111 having an upper side or surface 112 and an opposite, lower side or surface 113. An annular collar 114 extends upward, substantially perpendicular from the upper side 112 of the plate 111. A circular bore 115 extends through the collar 114 and the plate 111, substantially perpendicular to the lower side 113. The collar 114 and the bore 115 share a common central axis 199. The distal ends of the bore 115 are bevelled radially outward for reasons that will become apparent upon further description of the catch portion 100. A peg or stop 117 extends upward, substantially perpendicular from the upper side 112 of the plate 111, and proximate the collar 114. Also, two holes 119 are formed through the plate 111 on opposite sides of the collar 114, substantially perpendicular to the lower side 113.

Figure 4:
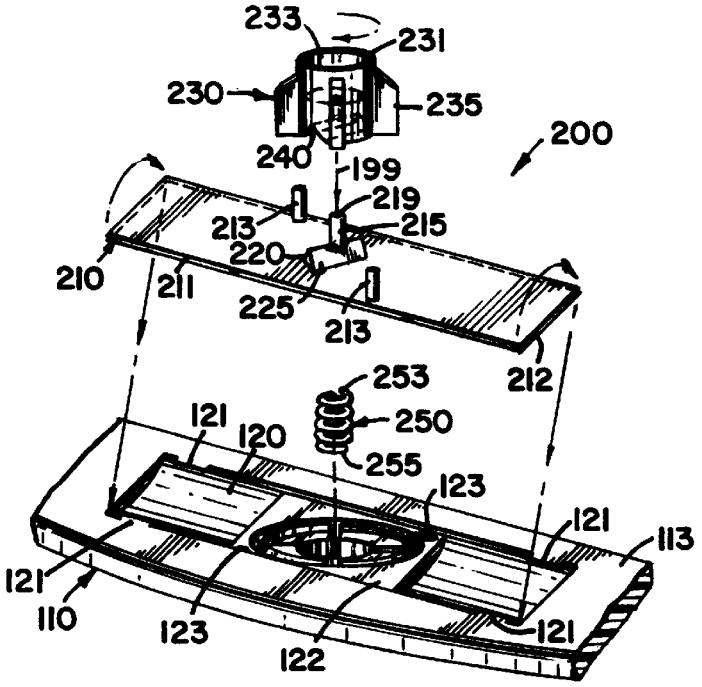
FIG. 4 is an exploded, isometric view of parts of the catch portion shown in FIG. 1.

As shown in FIG. 4, a depression 120 is formed into the lower side 113 of the plate 111, and four tabs 121 extend partially across the depression 120. A generally square subsurface 122 is nested within the depression 120 and centered relative to the axis 199. Two generally cylindrical openings 123 are formed in the subsurface 122 at diametrically opposed locations relative to both the axis 199 and the subsurface 122.

Figure 3:
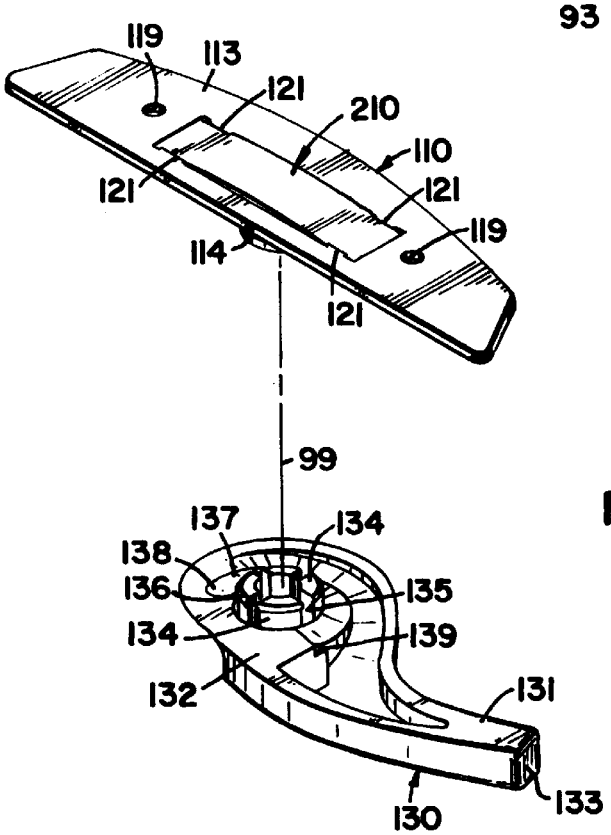
FIG. 3 is a partially exploded, isometric view of the catch portion shown in FIG. 1.

As shown in FIGS. 1, 3, and 7, the handle 130 and the catch 150 are integrally connected to one another and thus, are similarly disposed relative to the other components of the catch portion 100 of the latch mechanism 190. In other words, the catch 150 rotates relative to the base 110 to the same extent that the handle 130 rotates relative to the base 110.

The handle 130 includes a generally elongate operator member or bar 131 that extends generally radially from a first portion 132 rotatably mounted relative to the base 110, to a distal end 133. The first portion 132 includes four resiliently deflectable fingers 134, which are circumferentially spaced about the central axis 199, and which extend axially toward the base 110. The fingers 134 define gaps 135 therebetween, and the gaps 135 are similarly circumferentially spaced about the axis 199, and similarly extend axially toward the base 110. With the upper beveled end of the bore 115 serving as a guide, the fingers 134 deflect radially inward and toward one another to facilitate insertion thereof through the bore 115 in the plate 111. Once through the bore 115, the fingers 134 deflect radially outward and away from one another, and a radially outward extending lip 136 on each finger 134 engages the lower beveled end of the bore 115 to retain the fingers 134 within the bore 115.

A semi-circular groove or race 137 is formed in the handle 130 and receives the peg 117 on the plate 111. The peg 117 and the groove 137 cooperate to provide a means for limiting rotation of the handle 130 relative to the base 110. In particular, the handle 130 (as well as the catch 150) is free to rotate relative to the base 110 in a first direction about the axis 199 until the peg 117 encounters a first end 138 of the groove 137. Similarly, the handle 130 (as well as the catch 150) is free to rotate in a second, opposite direction until the peg 117 encounters a second, opposite end 139 of the groove 137. Intermediate portions of the fingers 134 function as an axle within the bore 115 to facilitate rotation of the handle 130 relative thereto.

Devices similar to the catch 150 and the keeper 170 are described in detail in U.S. Pat. No. 5,582,445 a continuation of U.S. patent application Ser. No. 08/407,404, now abandoned and a continuation of U.S. patent application Ser. No. 08/013,572 also now abandoned. The present application and the above-identified patent are assigned to a common assignee. The above-identified patent is incorporated herein by reference to the extent that it may facilitate understanding of the present invention. In general, the catch 150 includes a chamfered chamber 155 sized and configured to engage an arcuate engaging shoulder 175 on the keeper 170.

The means 200 for snapping the handle 130 and the catch 150 between a first position and a second position generally includes a bearing member 220, a rotor 230, and a coil spring 250, arranged in series within the base and secured between a plastic strip or cover 210 and the handle 130. The strip 210 is substantially flat and has a pair of parallel side edges 211 and a pair of parallel end edges 212 which cooperate to define a rectangular perimeter. The size and configuration of the strip 210 corresponds to the perimeter of the depression 120 in the base 110. Two posts 213 extend perpendicularly away from the strip 210 at diametrically opposed locations relative to a shaft 215, which also extends perpendicularly away from the strip 210.

The posts 213 insert into the holes 123 in the base 110 and ensure axial alignment of the shaft 215 and the axis 199. As a result, manufacturing tolerances associated with the dimensions of the strip 210 and the depression 120 can be relaxed somewhat. The posts 213 also function to discourage rotation of the strip 210 relative to the base 110. The strip 210 resiliently deflects to facilitate insertion into the depression 120 (which provides sufficient clearance for such deflection), and the tabs 121 overlay the side edges 211 to retain the strip 210 in place.

The bearing member 220 may be described as a bar or shoulder having a cross-section or profile in the shape of an isosceles triangle. The bearing member or bar 220 is disposed between the posts 213 and extends longitudinally in a direction perpendicular to a line drawn between the posts 213. The longitudinal axis of the bar 220 defines angles of 45 degrees relative to each of the side edges 211 of the strip 210. The bar 220 is integrally connected to the strip 210, and equal length sides or surfaces 225 of the bar 220 extend away from the strip 210 and converge at a vertex. The shaft 215 is integrally connected to the bar 220 and extends from the vertex to a distal end 219.

The rotor 230 includes a generally cylindrical body 231 having a first, relatively smaller hole 232 formed entirely therethrough, and a second, relatively larger hole 233 formed partially therein. The holes 232 and 233 are both centered about the common axis 199. In a preferred manufacturing process, the rotor 230 is integrally molded to a distal end of the shaft 215 on the strip 210. As explained below, the rotor 230 is subsequently separated from the shaft 215, leaving a nub on the distal end 219 thereof. The nub keeps the rotor 230 rotationally mounted on the shaft 215.

Four ridges or fins 235 extend radially away from the cylindrical body 231 at circumferentially spaced locations about the body 231. The ridges 235 are sized and configured to insert into the gaps 135 defined by the fingers 134 on the handle 130. The ridges 235, as well as the cylindrical body 231 itself, retain the handle 130 relative to the base 110 by discouraging deflection of the fingers 134 toward one another or radially inward. The ridges 235 also cooperate with the fingers 134 to rotatably secure the handle 130 relative to the rotor 230. In other words, the handle 130 and the rotor 230 rotate as a unit relative to the base 110, and the rotor 230 may be said to function as a hub for the handle 130.

A notch 240 is formed in an end of the cylindrical body 231 adjacent the strip 210. The notch 240 may be described as having a cross-section in the shape of an isosceles triangle, substantially similar in size and configuration to the profile of the bar 220. Equal length sides of the notch 240 extend inward from the end of the cylindrical body 231 to a vertex that is intersected by the axis 199.

The larger hole 233 in the cylindrical body 231 receives and retains an end 253 of the coil spring 250. An opposite end 255 of the spring 250 is disposed about a spindle 145 that extends axially from the handle 130, along the axis 199. The spring 255 is maintained in compression between the handle 130 and the rotor 230 and hence, forces the rotor 230 toward the bearing member 220 and the strip 210.

Assembly and operation of the latch mechanism 190 will now be described with reference to a preferred application of the present invention, wherein a first window sash is latched against movement relative to a second window sash. As shown in FIG. 7, the base 110 is secured to a first or lower sash 91 by means of screws 92, and the keeper 170 is secured to a second or upper sash 94 by means of screws 95. Those skilled in the art will recognize that various other means are available for mounting the latch. The lower sash 91 and the upper sash 94 are components of a double hung window assembly that is otherwise familiar to those skilled in the art.

First, the peg 117 on the base 110 is aligned relative to the groove 137 in the handle 130, and the fingers 134 on the handle 130 are forced through the bore 115 in the base 110 until they snap into place relative to the beveled lower end of the bore 115. Then, the spring 250 is positioned between the handle 130 and the rotor 230, and is aligned relative to the spindle 145 and the larger hole 233. Next, the handle 130 is rotated to either extreme orientation relative to the base 110, and the posts 213 on the strip 210 are aligned with and inserted into the holes 123 in the base 110. Finally, plungers force the strip 210 into the depression 120 until it snaps into place behind the tabs 121, and also force the rotor 230 to break from the shaft 215. In particular, a first plunger engages the strip 210 proximate the axis 199, and additional plungers engage respective ends of the strip 210, generally between respective pairs of opposing tabs 121.

Prior to the break caused by the plungers, the notch 240 on the rotor 230 is aligned with the bearing member 220 on the strip 210. Thus, the integral molding of the strip 210 and the rotor 230 eliminate several manufacturing steps that might otherwise be necessary, including: (a) forcing the rotor 230 onto the shaft 215; (b) aligning the ridges 235 on the rotor 230 with the gaps 135 in the handle 130; and/or (c) aligning the notch 240 in the rotor 230 with the bearing member 220 on the strip 210.

At this point, the latch mechanism 190 is ready for attachment to a window sash. In the interest of manufacturing efficiency, the strip 210 need not be made sufficiently rigid to remain flush with the lower side 113 of the base 110 prior to installation (particularly when subjected to the force in the spring 250 during rotation of the handle 130). However, as shown in FIG. 3, the strip 210 is nonetheless sufficiently rigid to retain the spring 250 and the rotor 230 relative to the base 110 to facilitate installation of the latch mechanism 190 and testing of the latch mechanism 190 prior to installation.

A significant advantage of the present invention is that the catch portion 100 of the latch mechanism 190 has a flush lower side 113 and thus, does not require any milling or other alteration of the lower sash 91 (other than the two holes necessary to receive the screws 92). In other words, the latch mechanism 100 is simply positioned on an upwardly facing check rail surface 93 of the lower sash 91 and secured in place. The forces acting on the screws 92 draw the base 110 into tight contact with the surface 93 and effectively flatten the strip 210. Despite being mounted entirely above the surface 93, the flush mounted latch mechanism is relatively compact as well.

As a result of the assembly process described above, the notch 240 in the rotor 230 is aligned with the bearing member 220 on the strip 210 when the handle 130 is in either extreme orientation relative to the base 110. When the handle 130 is in a first extreme orientation, as shown in solid lines in FIG. 7, the chamfered chamber 155 on the catch 150 engages the arcuate engaging shoulder 175 on the keeper 170 and thereby latches the lower sash 91 relative to the upper sash 94. When the handle 130 is in a second, opposite extreme orientation, as shown in phantom lines in FIG. 7, the chamfered chamber 155, as well as the elongate bar portion 131 of the handle 130, is clear of the arcuate engaging shoulder 175, and the lower sash 91 is free to move relative to the upper sash 94.

Figure 5A:
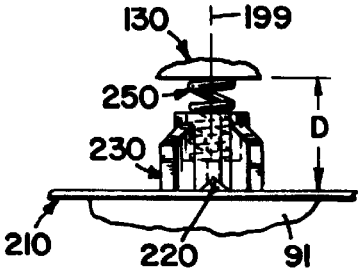
FIG. 5*a* is a side view of parts of the catch portion shown in FIG. 1, depicted relative to a window sash check rail.
Figure 5B:
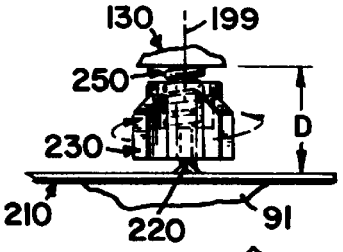
FIG. 5*b* is a side view of the parts shown in FIG. 5*a*, depicted in a different orientation relative to one another and the window sash check rail.
Figure 6:
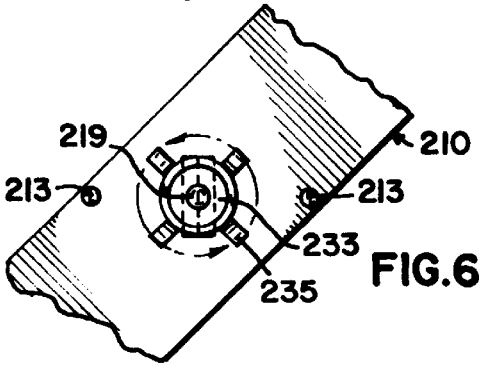
FIG. 6 is a top view of some of the parts shown in FIGS. 5*a* and 5*b*.

Recognizing that the handle 130 and the strip 210 are maintained a fixed distance D apart (particularly after installation of the latch mechanism 190), the spring 250 is less compressed when the notch 240 in the rotor 230 is aligned with the bearing member 220 on the strip 210, as shown in FIG. 5*a*, and the spring 250 is more compressed when the notch 240 and the bearing member 220 are not aligned relative to one another, as shown in FIG. 5*b*. In other words, subject to resistance due to compression of the spring 250, the notched rotor 230 rides radially upward as it rotates relative to the angled surfaces of the bearing member 220. The resulting greater compression in the spring 250 biases the notch 240 and the bearing member 220 toward relative alignment and thus, also biases the handle 130 toward each of the extreme orientations relative to the base 110. Among the benefits of this arrangement are positive feedback to a person operating the latch, improving the likelihood that the sash will be either entirely latched or entirely unlatched, and that the mechanism will remain either entirely latched or entirely unlatched once so positioned.

The operating characteristics or "feel" of the latch are a function of the configurations of the bearing member 220 and the notch 240 and thus, can be varied to suit different preferences. For example, a parabolic profile for the bearing member 220 and the notch 240 would cause the rotor 230 to travel more gradually along the axis 199 when near either of the extreme positions and would tend to reduce the range of rotation not subject to the compressive force of the spring 250, as compared to the isosceles triangle profile.

Although the present invention has been described with reference to a preferred embodiment and a specific application, those skilled in the art will recognize other embodiments and applications that fall within the scope of the present invention. For example, the present invention is also suitable for use on glider windows. Accordingly, the present invention is to be limited only to the extent of the appended claims.

I claim:

1. A window assembly having a frame, a first sash movably mounted within the frame, and a second sash mounted within the frame, the window assembly further comprising;

a keeper mounted on the second sash;

a catch mounted on the first sash in such a manner that when the first sash is moved to a closed position relative to the second sash, said catch is movable to selectively interengage said keeper and lock the first sash in said closed position;

a handle mounted on the first sash in such a manner that movement of said handle in a first direction moves said catch into interengagement with said keeper when the first sash is in said closed position, and movement of said handle in a second, opposite direction moves said catch out of interengagement with said keeper;

a compression spring, a rotor, and a bearing member arranged in series between said handle and the first sash, wherein said rotor rotates relative to said bearing member in response to movement of said handle, and energy stored in said spring forces said rotor toward said bearing member, and interengaging surfaces on said rotor and said bearing member are configured to minimize compression of said spring in any of at least two discrete orientations relative to one another, wherein in one of said at least two discrete orientations said catch interengages said keeper when the first sash is in said closed position, and in another of said at least two discrete orientations said catch is free of said keeper wherein the movement of said handle is in the plane of rotation of the handle only.

2. A window assembly according to claim 1, wherein said spring, said rotor, and said bearing member are housed within a base that is disposed between said handle and the first sash.

3. A window assembly according to claim 2, wherein said bearing member is an integral portion of a strip removably secured to said base.

4. A window assembly according to claim 1, wherein said catch and said handle are integrally connected to one another.

5. A window assembly according to claim 1, wherein said rotor functions as a hub relative to said handle.

6. A window assembly according to claim 1, wherein said interengaging surfaces include:

an outer surface on a triangular bar on said bearing member, having a peak directed toward said rotor; and a diametrically extending triangular notch formed in an end of said rotor, having sides diverging away from a vertex in a direction toward said bearing member.

7. A latch mechanism that selectively latches a first sash against movement relative to a second sash, comprising:

a shaft having a longitudinal axis;

a rotor mounted on said shaft and rotatable about said longitudinal axis;

a handle connected to said rotor and rotatable together with said rotor about said longitudinal axis;

a locking means for selectively locking the first sash relative to the second sash, wherein said locking means includes a keeper means attached to the second sash and a catch means connected to said handle in such a manner that rotation of said handle effects engagement and disengagement of said catch means with said keeper means of said locking means; and a biasing means engaged with said rotor, for biasing said rotor and said handle toward any of at least two discrete orientations, including a first orientation consistent with engagement of said locking means catch means with said keeper means, and a second orientation consistent with disengagement of said catch means with said keeper means, wherein said biasing means causes said rotor to travel axially along said shaft and relative to said handle between positions of relatively greater and lesser stability, and positions of relatively greater stability are associated with said first orientation and said second orientation.

8. A latch mechanism according to claim 7, wherein axially extending ridges on said rotor engage axially extending slots in said handle.

9. A latch mechanism according to claim 8, further comprising a base having a hole formed through at least a portion thereof, wherein axially extending fingers on said handle resiliently deflect inward toward one another to insert through said hole and subsequently deflect outward to rotatably secure said handle relative to said base.

10. A latch mechanism according to claim 9, wherein said axially extending slots are defined between said axially extending fingers.

11. A latch mechanism according to claim 7, wherein said biasing means includes a spring disposed between said handle and said rotor, and said spring urges said rotor axially away from said handle.

12. A latch mechanism according to claim 11, wherein said spring is a helical spring that is disposed on a spindle integrally joined to said handle and coaxially aligned with said shaft.

13. A latch mechanism according to claim 7, further comprising a nub on a distal end of said shaft, wherein said nub retains said rotor on said shaft.

14. A latch mechanism according to claim 7, further comprising a base to which said handle is rotatably mounted, wherein said base includes a mounting means for mounting said base to one of the first sash and the second sash.

15. A latch mechanism according to claim 14, further comprising a rotation limiting means interconnected between said handle and said base, for limiting rotation of said handle relative to said base within a desired range.

16. A latch mechanism according to claim 15, wherein said limiting means includes a semi-circular groove formed in said handle and opening toward said base, and a pin extending from said base into said groove.

17. latch mechanism according to claim 14, further comprising a strip secured to said base to retain said biasing means between the strip and the rotor.

18. A latch mechanism according to claim 17, wherein said biasing means includes a shoulder extending from said strip toward said rotor, and a surface on said rotor engages said shoulder, and when said handle is in either of said first orientation and said second orientation, at least one notch in said surface receives said shoulder and thereby places said rotor in a position of relatively greater stability.

19. A latch mechanism according to claim 18, wherein said shaft and said shoulder are integral portions of said strip, and said shaft extends from a symmetrically central portion of said shoulder toward said rotor.

20. A latch mechanism according to claim 18, wherein at least one post extends from said strip and into a hole in said base to facilitate axial alignment of said rotor and said handle.

21. A latch mechanism according to claim 17, wherein said strip is nested within a depression in said base, and tabs extend from said base across portions of said depression to retain said strip relative thereto.

22. A latch mechanism according to claim 7, further comprising a rotation limiting means connected to said handle, for limiting rotation of said handle to a range of rotation defined between and inclusive of said first orientation and said second orientation.

23. A latch mechanism that selectively latches a sash against movement relative to a member to which the sash is movably mounted, comprising:

a base having a planar side suitable for mounting to a flat surface on the sash, and having a cavity extending into said side;

an interengaging means for selectively interengaging the sash and the member;

a handle rotatably mounted relative to said base opposite said side, wherein said handle is rotatable about an axis of rotation, and rotation of said handle relative to said base operates said interengaging means and wherein normal operating movement of said handle is limited to movement in the plane of rotation of said handle; and a biasing means disposed within said cavity and interconnected between said base and said handle, for biasing said handle toward any of at least two discrete orientations relative to said base, wherein in one of said at least two discrete orientations said interengaging means interengages the sash and the member, and in another of said at least two discrete orientations said interengaging means disengages the sash and the member.

24. A latch mechanism according to claim 23, further comprising a semi-rigid retaining means removably connected to the side of said base wherein the rigidity of the retaining means is sufficient to remain engaged with the base vet insufficient to remain flush with said side of said base prior to mounting of said base on the flat surface and wherein the retaining means is insufficiently rigid such that when the base is mounted on the flat surface the retaining means is forced into a flush relationship relative to said side.

25. A latch mechanism according to claim 24, wherein said retaining means is a strip of plastic that snap fits behind tabs on said base.

26. A latch mechanism according to claim 24, wherein said biasing means includes a compression spring coaxially aligned relative to said axis of rotation.

27. A latch mechanism according to claim 26, wherein said biasing means further includes a shoulder connected to said retaining means and extending toward said cavity, and a rotor disposed between said retaining means and said spring in such a manner that said rotor rotates together with said handle relative to said base, and at least one notch in said rotor receives said shoulder when said handle is in said one of said at least two discrete orientations, and at least one notch in said rotor receives said shoulder when said handle is in said another of said at least two discrete orientations.

28. A latch mechanism according to claim 27, wherein as said handle is moved between said one of said at least two discrete orientations and said another of said at least two discrete orientations, said rotor travels away from said retaining means, along said axis of rotation, and against force exerted by said spring.

29. A latch mechanism according to claim 27, wherein said retaining means is a strip of plastic, and said shoulder is an integral portion thereof.

30. A latch mechanism according to claim 27, wherein said rotor is integrally molded together with said retaining means, and when said retaining means is connected to said base, said rotor separates from said retaining means and is automatically rotatably mounted on a shaft integrally molded to said retaining means.

* * * * *